United States Patent [19]

Pálsson

[11] 4,172,532

[45] Oct. 30, 1979

[54] CLOSURE ASSEMBLY FOR A CONTAINER AND A KEY FOR OPENING

[76] Inventor: Jóhannes S. Pálsson, Nýbylaveg 36, Hvolsvöllur, Iceland

[21] Appl. No.: 887,633

[22] Filed: Mar. 17, 1978

[30] Foreign Application Priority Data

Mar. 17, 1977 [DK] Denmark ..... 1166/77

[51] Int. Cl.[2] ..... B65D 55/02; B65D 85/56; A61J 1/00

[52] U.S. Cl. ..... 215/215; 215/296; 215/302

[58] Field of Search ..... 215/215, 296, 302; 206/1.5

[56] References Cited

U.S. PATENT DOCUMENTS

| | | | |
|---|---|---|---|
| 3,276,612 | 10/1966 | Caldwell | 215/215 |
| 3,393,815 | 7/1968 | Turecek | 215/215 X |
| 4,056,209 | 11/1977 | Winkler | 215/215 |

*Primary Examiner*—George T. Hall
*Attorney, Agent, or Firm*—Holman & Stern

[57] ABSTRACT

A closure assembly for a bottle or container which has a cylindrical neck portion and a lid with a skirt. The lid skirt is detachably fitted to the neck portion by cooperating beads on it and a cylindrical collar which is securely mounted on the neck portion by transverse members. The collar is disposed at a radial distance from the neck portion and encloses at least part of the skirt. The transverse members are adapted to cooperate in a camming manner with one or more projections on the skirt so that turning of the fitted lid relatively to the neck portion results in an axial displacement of the lid. The lid is constructed to be turned by an implement such as a T-shaped handle key or a coin. For this a slot can be provided disposed along a diameter. The inside of the lid can be formed with projecting wall members defining an inwardly closed cavity around the slot with shape of a narrow cylindrical section. The transverse members can be constituted by a transverse wall formed with one or more depressions at least partially defined by inclined wall members. Preferably four symmetric depressions uniformly spaced along the circumference of the neck portion are provided with the lid skirt having two diametrically opposed projections substantially complementary to the depressions.

9 Claims, 4 Drawing Figures

CLOSURE ASSEMBLY FOR A CONTAINER AND A KEY FOR OPENING

Figure 1:
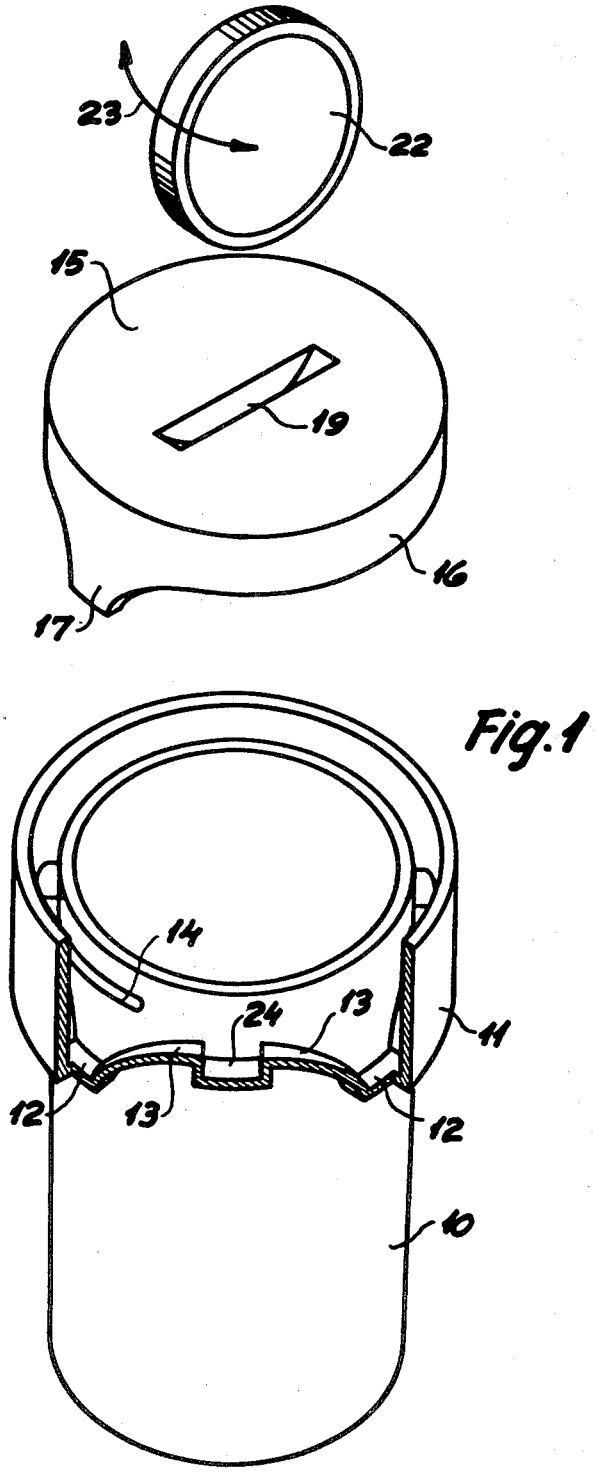

The invention relates to a closure assembly for a bottle or container, preferably for packing medicine, which comprises a cylindrical neck portion and a lid with a skirt which by means of co-operating beads on the neck portion and the lid skirt may be detachably attached on the neck portion on which a substantially cylindrical collar is securely fitted by means of one or more transverse members, said collar being disposed at some radial distance from the neck portion and encloses at least a part of the skirt of the assembled lid.

In a known construction of such a closure assembly the substantially cylindrical collar serves to prevent unintentional removal of the lid, for example during handling or transport of the bottle or container. In this known construction the collar is provided with a depression giving access to the lid. In other known closures of the subject type the cylindrical collar serves to make it more difficult to remove the lid so that children and others who are ignorant of the dangerous contents of the bottle or the container, cannot open the bottle or container, which may be example be a pill bottle.

The object of the invention is to provide a closure assembly of the subject type which by simple and inexpensive means ensures that a medicine bottle or container is not opened by unauthorized persons, without making it too difficult to physically handicapped individuals to remove the lid. This object is achieved by arranging the closure assembly of the invention so that the transverse member or members are adapted to co-operate in a camming manner with one or more of the projections on the lid skirt so that turning of the fitted lid relatively to the neck portion results in an axial displacement of the lid, said lid being provided with means with which an implement may be engaged for turning the lid.

The projections on the lid skirt and/or the transverse members between the neck portion and the substantially cylindrical collar may be shaped with cam faces of such an inclination that a suitable cam effect is obtained for overcoming the resistance to the removal of the lid which is caused by the beads engaged behind each other when a reasonable force is applied to the lid to turn it.

The lid may be fitted by a purely axial pressure without a turning movement provided that the projections on the lid skirt are pre-positioned correctly in relation to the transverse members.

In a preferred embodiment of the invention the closure assembly is further characterized in that the transverse members between the neck portion and the skirt are constituted by a transverse wall formed with one or more depressions at least partially defined by inclined wall members.

Hereby it is achieved that the transverse wall prevents removal of the lid by inserting from below an implement up towards the lower edge of the lid skirt between the neck portion and the collar.

An embodiment of the closure assembly which is expedient in practice is characterized in that the transverse wall has four symmetric depressions uniformly spaced along the circumference of the neck portion, and that the lid skirt has two diametrically opposite projections substantially complementary to the depressions.

A particularly simple embodiment of the closure assembly is characterized in that the means for engagement with an implement are constituted by a slot in the lid, said slot being disposed along the central portion of a diameter, and that the inside of the lid is provided with projecting wall members defining an inwardly closed cavity around the slot.

The implement may be a coin or another article which has such a shape and rigidity that it may be inserted into the slot and cause the lid to turn when it is turned itself.

A particularly expedient embodiment of the closure assembly, when a coin is used as an opening implement, is characterized in that the wall members are formed so as to give the cavity and the slot the shape of a narrow cylinder section. The width of the slot may optionally be adjusted relatively to the thickness of a coin suitable for the purpose so that said coin is clamped in the lid so that said lid cannot only be disengaged from its locking engagement with the cylindrical neck portion, but can also be withdrawn completely from the space between this neck portion and the collar by means of the coin.

The invention also relates to a specific key for use in connection with the subject closure assembly. Said key is characterized by having an insertion portion defined by substantially plane parallel sides, said insertion portion being a tight fit in the slot of the lid, and by having at least at one end of said insertion portion an abutment portion whose dimension in a direction perpendicularly to the insertion portion exceeds the width of the slot.

Said arrangement ensures that the key can easily be removed after use by turning it around the abutment member whereby it is assured that the lid remains in the fitted position.

A practical embodiment of the key is characterized in that the abutment portion is constituted by a shoulder disposed substantially perpendicularly to the insertion portion and extending throughout its length and defining the insertion portion from a substantially T-shaped handle.

As an axial pressure must be applied to the lid when it is to be removed, for example by means of a coin, the projections are, once they have slid up the inclined wall members, apt to continue down the adjacent inclined wall members to end in the adjacent depressions. This drawback may be obviated by providing the closure assembly of the invention with a recess in the transverse wall between each pair of adjacent depressions.

In such a construction the recesses act as stop means which in co-operation with the projections stop the movement of the lid in a position favourable to the removal of the lid.

The cylindrical neck portion may be constituted by the neck or the upper part of a container of bottle; it may also be adapted to be mounted on an existing bottle or container so that said assembly constitutes an independent unit for use in connection with existing bottles or containers. The neck portion may for example be shaped with a thread mating with the thread on a glass bottle with a screw-on cap.

Figure 2:
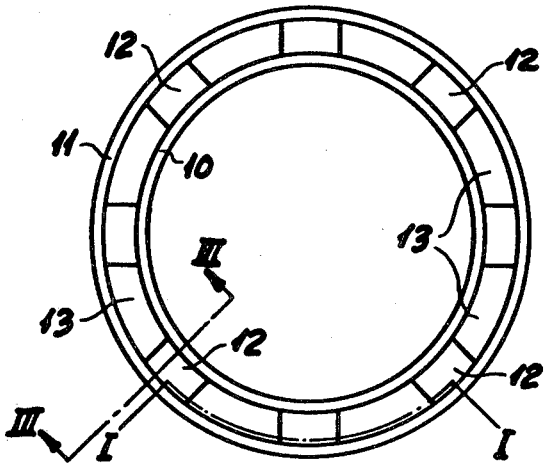
Figure 3:
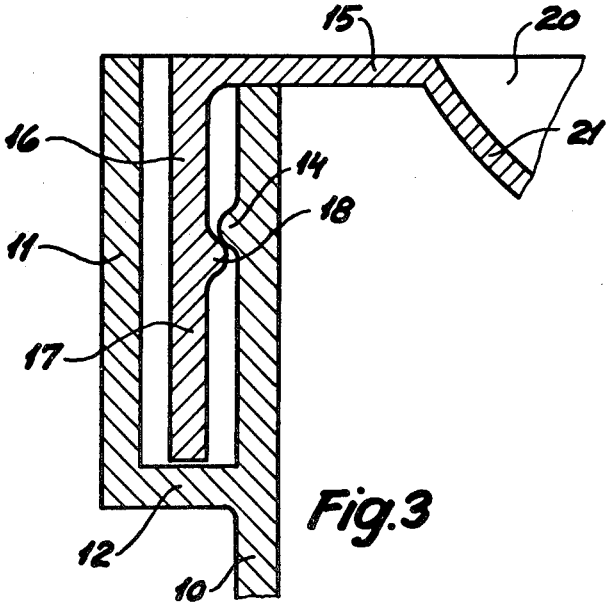
Figure 4:
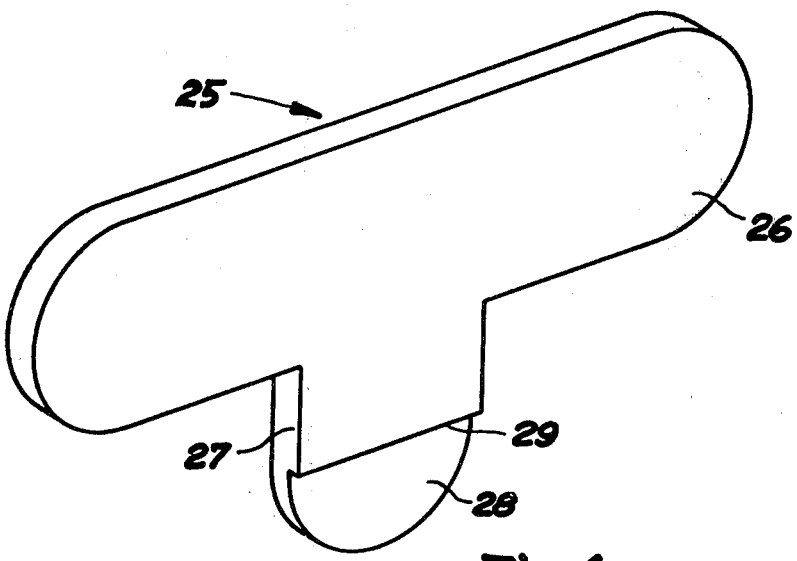

The invention will be described in more detail below with reference to the drawing wherein FIG. 1 is a perspective view partially in section of a cylindrical container with an embodiment of the closure assembly according to the invention and a coin for turning the lid shown separately, FIG. 2 is a top view of the container without lid, FIG. 3 shows a larger scale an axial section taken along the line III—III in FIG. 1, and FIG. 4 is a perspective view of an embodiment of the key according to the invention.

In the drawing 10 designates a cylindrical container for packing medicaments, for example pills. The container is enclosed aling its upper edge by a cylindrical collar 11 connected to the container wall through an annular transverse wall having four comparatively short, plane parts 12 spaced by right angels and disposed at the lower edge of the collar 11 and interconnected by four arcuate members 13 whose tops are located at a comparatively short distance below the upper edge of the container 10. A recess 24 is formed in each of these tops. The arcuate transverse wall members 13 define four depressions whose bottoms are constituted by the plane transverse wall members 12. Opposite two diametrically opposed depressions and somewhat below the upper edge the container 10 is on the outside provided with a low and narrow bead or rib 14 etending circumferentially through an angle of somewhat less than 90°.

The lid has the shape of a circular disc 15 with a cylindrical skirt 16 which has two diametrically opposite projections 17 of substantially the same shape as the depressions in the transverse wall 12, 13. On the inside the skirt has an annular bead 18 spaced from the disc 15 so that when the lid is fitted it may pass beyond the ribs 14 on the container with a snap effect and thus serve to maintain the lid in the fitted position as shown in FIG. 3. This function presupposes of course that either the lid or the container is produced from a material having a certain flexibility, for example a suitable plastic material. As also seen in FIG. 3, the collar 11 protrudes above the edge of the container 10, this protrusion corresponding to the thickness of the disc 15.

In the middle of the disc 15 there is provided a slot 19 which together with a cavity, which is defined by two wall members 20 projecting from the inside of the disc 15 and having the shape of a segment of a circle and a curved wall member 21, form a means for receiving a suitable implement such as a coin 22.

When the coin after having been inserted in the slot in the fitted assembled lid, is turned in one or the other direction as indicated by a curved double arrow 23, the lid is turned in the same direction, whereby the projections 17 on the skirt 16 slide up on two of the arcuate transverse wall members 13 and thus causes the lid to be moved axially upwardly so that the bead 18 on the lid skirt is pressed past the ribs 14 on the container 10, resulting in the disengagement of the lid. When the projections have reached the top of the arcuate wall members 13 they engage the recesses 24, whereby the movement of the lid is stopped, and then the lid can easily be removed. On the other hand it is impossible to remove the lid without an implement that may be engaged with the slot and which is sufficiently rigid and strong to turn the lid against the resistance exerted by the ribs 14 to the passage of the bead 18, because the collar 11 prevents the lid from being gripped by the fingers.

FIG. 4 shows a key which is particularly suitable for removing the lid 15, 16. The key is designated 25 and is plate-shaped with a substantially T-shaped contour. The transverse member 26 has rounded ends and forms a handle. The central leg 27 terminates in a rounded insertion portion 28 whose thickness is adapted to the width of the slot 19 so that it may be inserted and maintained therein by clamping. The insertion portion 28 is separated from the other portion of the said leg 27 by a shoulder 29 constituting an abutment member which is caused to bear against the disc 15. When the key is to be removed again, it is tilted around one end edge of the shoulder while simultaneously exerting a pressure downward against the lid through said edge, whereby the key can be safely removed from the lid without loosening the latter from the neck portion 10.

The constructional details of the closure assembly according to the invention, for example the shape and the distribution of the co-operating cam faces on container and lid, may be arranged in ways other than the one shown in the drawing and described in the foregoing text. The closure assembly may also be shaped as an independent unit that may be mounted on an existing container, for example a glass bottle.

What I claim is:

1. A closure assembly for a bottle or container, preferably for packing medicine, which comprises a cylindrical neck portion and a lid with a skirt which by means of co-operating beads on the neck portion and the lid skirt may be detachably attached on the neck portion on which a substantially cylindrical collar is securely mounted by means of one or more transverse members, said collar being disposed at some radial distance from the neck portion and encloses at least a part of the skirt of the fitted lid, characterized in that the transverse member or members are adapted to-co-operate in a camming manner with one or more projections on the lid skirt so that turning of the fitted lid relatively to the neck portion results in an axial displacement of the lid, said lid being provided with means with which an implement may be engaged for turning the lid.

2. A closure assembly according to claim 1, characterized in that the transverse members between the neck portion and the skirt are constituted by a transverse wall formed with one or more depressions at least partially defined by inclined wall members.

3. A closure assembly according to claim 2, characterized in that the transverse wall has four symmetric depressions uniformly spaced along the circumference of the neck portion, and that the lid skirt has two diametrically opposite projections substantially complementary to the depressions.

4. A closure assembly according to claim 1, characterized in that the means for engagement with an implement are constituted by a slot in the lid, said slot being disposed along the central portion of a diameter, and that the inside of the lid is formed with projecting wall members defining an inwardly closed cavity around the slot.

5. A closure assembly according to claim 4, characterized in that the wall members are formed so as to give the cavity and the slot the shape of a narrow cylinder section.

6. A key for use in connection with a closure assembly according to claim 4, characterized by having an insertion portion defined by substantially plane parallel sides, said insertion portion being a tight fit in the slot of the lid, and by having at least at one end of said insertion portion an abutment portion whose dimension in a direction perpendicularly to the insertion portion exceeds the width of the slot.

7. A key according to claim 6, characterized in that the abutment portion is constituted by a shoulder disposed substantially perpendicularly to the insertion portion and extending throughout its length and defining the insertion portion from a substantially T-shapd handle.

8. A closure assembly according to claim 2, characterized in that a recess is formed in the transverse wall between each pair of adjacent depressions.

9. A closure assembly according to claim 1, characterized in that the cylindrical neck portion is adapted to be mounted on an existing bottle or container.

* * * * *